US006708629B2

(12) United States Patent
Dumouchel

(10) Patent No.: US 6,708,629 B2
(45) Date of Patent: Mar. 23, 2004

(54) GOODS PALLET

(75) Inventor: Catherine Dumouchel, Saint-Maur (FR)

(73) Assignee: Cybele Environnement, Lens (FR)

( * ) Notice: Subject to any disclaimer, the term of this patent is extended or adjusted under 35 U.S.C. 154(b) by 0 days.

(21) Appl. No.: 09/987,500

(22) Filed: Nov. 15, 2001

(65) Prior Publication Data

US 2002/0056406 A1 May 16, 2002

(30) Foreign Application Priority Data

Nov. 16, 2000 (FR) ..... 00 14784

(51) Int. Cl.[7] ..... B65D 19/38
(52) U.S. Cl. ..... 108/57.25
(58) Field of Search ..... 108/57.25, 57.29, 108/901, 902, 51.11, 51.3, 56.1

(56) References Cited

U.S. PATENT DOCUMENTS 2,501,506 A * 3/1950 Geirge
3,126,843 A 3/1964 Laney
3,602,157 A 8/1971 Cohen
5,042,397 A * 8/1991 Fiedler
5,417,167 A * 5/1995 Sadr
5,440,998 A * 8/1995 Morgan, IV et al.
5,493,962 A * 2/1996 McCarthy
6,352,039 B1 * 3/2002 Woods et al.

FOREIGN PATENT DOCUMENTS

EP 0 609 611 A2 8/1994

* cited by examiner

*Primary Examiner*—Jose V. Chen
(74) *Attorney, Agent, or Firm*—Young & Thompson

(57) ABSTRACT

A goods pallet comprising parallel supports having at least end portions fixed by structure to cross-connection elements, each cross-connection element comprising a beam of channel section having a top flange to which the support elements are fixed, and a web and a bottom flange which are both recessed by at least one notch to form two spaced-apart brackets on either side thereof that are integral with the top flange.

19 Claims, 3 Drawing Sheets

GOODS PALLET

BACKGROUND OF THE INVENTION

In conventional manner, such a pallet is made of wood and generally comprises support planks on which goods are placed. The support planks are parallel to one another and they are held spaced apart from base planks which are likewise parallel to one another and to the support planks, by means of three cross spacer elements which are fixed to the base planks so as to interconnect them, with fixing being performed by nails passing through the support planks in the middle and at the ends. As a general rule, the spacer elements comprise three solid blocks, interconnected by top and bottom cross-members, and to which the support and base planks are fixed, respectively.

A drawback of such pallets is that they comprise a large number of elements (twenty-four for the most widespread pallet structure, namely: six support planks, three top cross-members, nine blocks, three bottom cross-members, and three base planks), which leads to assembly costs, labor costs, and stock management costs that are all relatively large. The time required for manufacture is also relatively long.

Furthermore, wooden pallets are relatively fragile and need to be repaired regularly. In addition, wooden pallets suffer from the drawback of taking up moisture, thereby increasing their weight. Furthermore, when a pallet stands on a damp surface, moisture tends to rise as far as the support planks and possibly also to reach the goods stored on the pallet.

OBJECTS AND SUMMARY OF THE INVENTION

An object of the invention is to propose a pallet of structure that is robust and simple.

To achieve this object, the invention provides a goods pallet comprising parallel support elements having at least end portions fixed by assembly means to cross-connection elements, each of which comprises a beam of channel section having a top flange to which the support elements are fixed, and a web and a bottom flange which are both recessed by at least one notch to form two spaced-apart brackets on either side thereof that are integral with the top flange.

A pallet made in this way is easily made by assembling together its various elements and it presents properties similar to those of conventional pallets, in particular wooden pallets, and possibly even better than those of pallets made of ordinary types of injected thermoplastic material. The channel section of the beam thus ensures good distribution of the weight supported by the pallet. In addition, this beam presents good mechanical strength because of its structure, thus making it possible, in particular compared with conventional wooden pallets, to avoid using a bottom cross-member uniting the brackets, which makes it possible to reduce the height of the pallet. In addition, by using such a beam, various portions of the conventional assembly are formed as a single piece (two cross-members and three blocks in the above-described prior art wooden pallet), thus reducing the number of parts and simplifying manufacture of the pallet. The cross beams can also be made out of materials which do not absorb moisture, thereby preventing moisture from rising into the goods supported by the pallet.

In a particular embodiment, the pallet comprises at least one stiffener element extending parallel to the support elements and at a distance therefrom between two opposite brackets, the stiffener element being formed by a plank-shaped beam, the bottom surface of the beam being grooved and the beam having at least one chamfer formed in at least one of its top longitudinal edges. The resulting pallet is thus particularly strong. This also makes it possible firstly to lighten the pallet and secondly to reduce the risk of impact between the stiffener element and the tips of forklift tines.

Advantageously, the cross beam comprises at least one reinforcing rib at at least one of its brackets, the reinforcing rib extending over the web between the top and bottom flanges.

The cross beam then presents increased resistance to the impacts that the tines of forklift trucks can impart against the web of the cross beam.

According to a particular characteristic, at least the cross beams are made out of a thermoplastic material.

New polyethylene terephthlate is a material that is frequently used to manufacture mass-produced products such as bottles or common consumer articles. Recycled polyethylene terephthlate, in particular when it comes from household waste, is often heterogeneous in nature having physico-chemical characteristics of relatively poor level, thereby restricting its use as a recycled product to manufacturing parts that are thin and of mediocre quality, and that are made out of materials incorporating only a small quantity thereof. Given the volumes of products made out of new polyethylene terephthlate and the difficulty in recycling this material, recycling all of the polyethylene terephthlate that is produced is not a practical possibility at present. This is amplified by the fact that recycled polyethylene terephthlate, and indeed ordinary quality new polyethylene terephthlate, is unsuitable for use in making bulky parts that are solid. As a result the quantity of polyethylene terephthlate that can be recycled in products is limited.

Thus, in the invention the thermoplastic material comprises:

- recycled polyethylene terephthalate;
- recycled high density polyethylene;
- a compatibility agent; and
- a reinforcing filler, and advantageously comprises, by weight:
- approximately 49% to 63.5% and preferably 55% of polyethylene terephthalate;
- approximately 27% to 36% and preferably 33% of high density polyethylene;
- approximately 4% to 6% and preferably 5% compatibility agent; and
- approximately 5% to 10% and preferably 7% of reinforcing filler.

This provides in simple manner a cross beam made of recycled material that is solid and bulky in structure. The part presents mechanical characteristics which are satisfactory, and in the preferred composition come close to those of wood, with this applying in particular to breaking strength, thereby enabling parts made of this material to be assembled in similar ways to wood.

BRIEF DESCRIPTION OF THE DRAWINGS

Other characteristics and advantages of the invention will appear on reading the following description of a particular, non-limiting embodiment of the invention.

Reference is made to the accompanying drawings, in which.

MORE DETAILED DESCRIPTION

Figure 1:
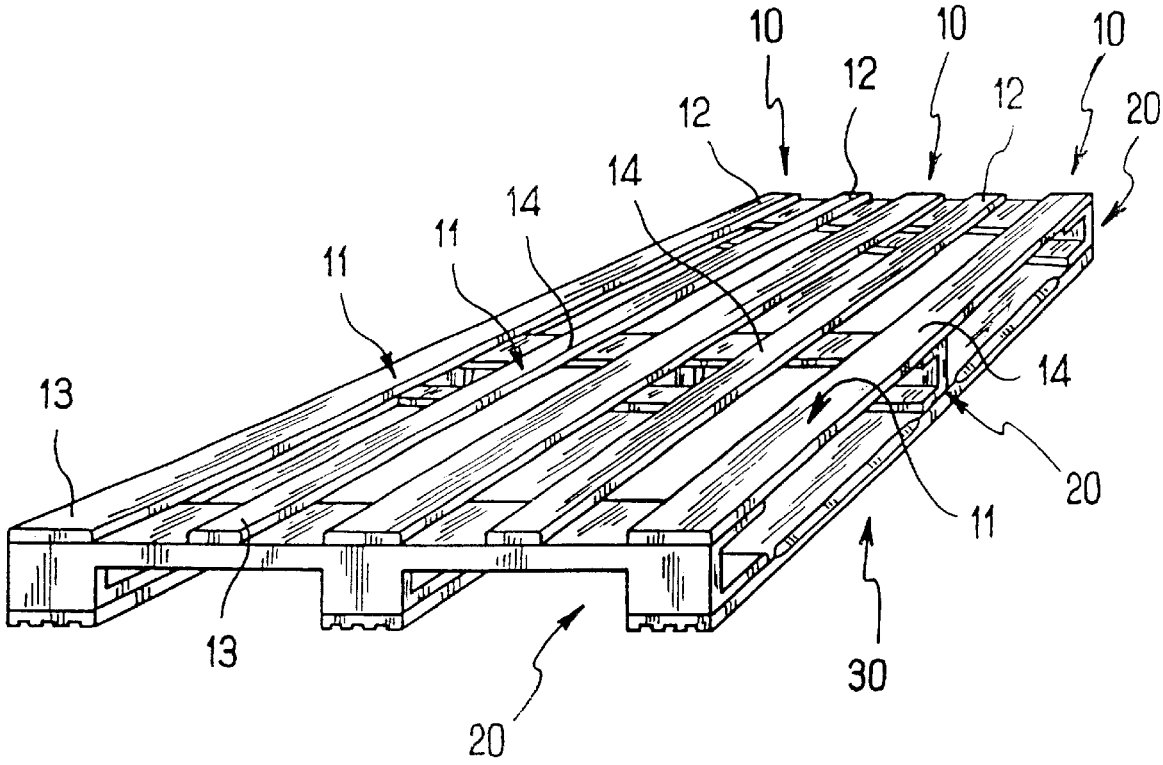
FIG. 1 is a perspective view of a pallet of the invention.
Figure 2:
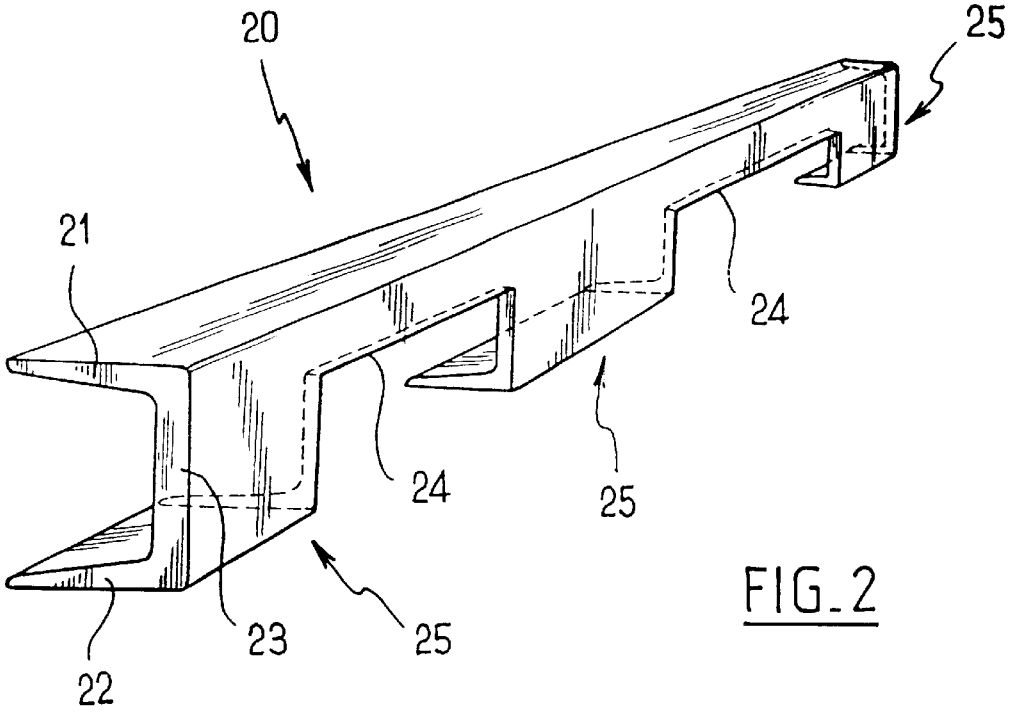
FIG. 2 is a perspective view of a first type of beam used in the pallet of the invention.
Figure 3:
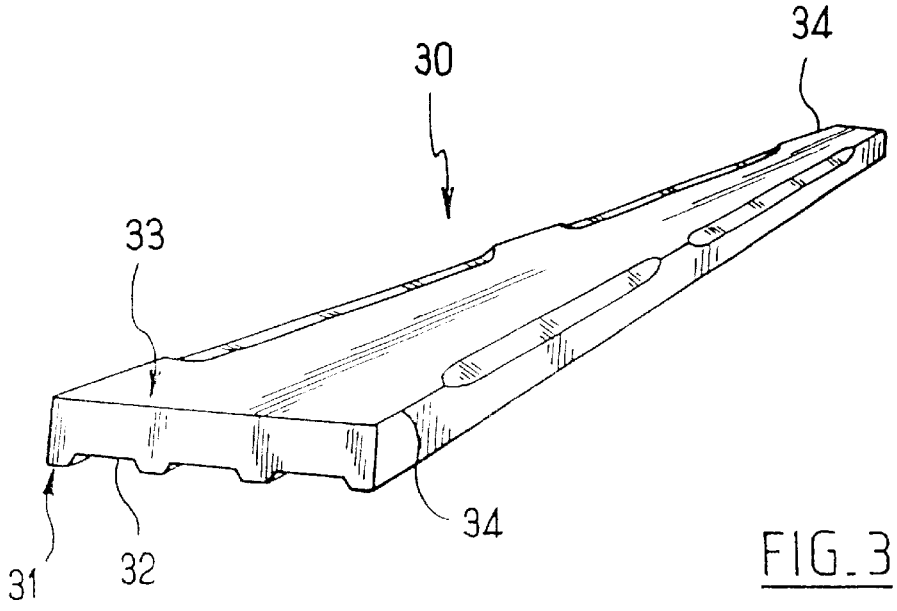
FIG. 3 is a perspective view of a second type of beam used in the pallet of the invention.
Figure 4:
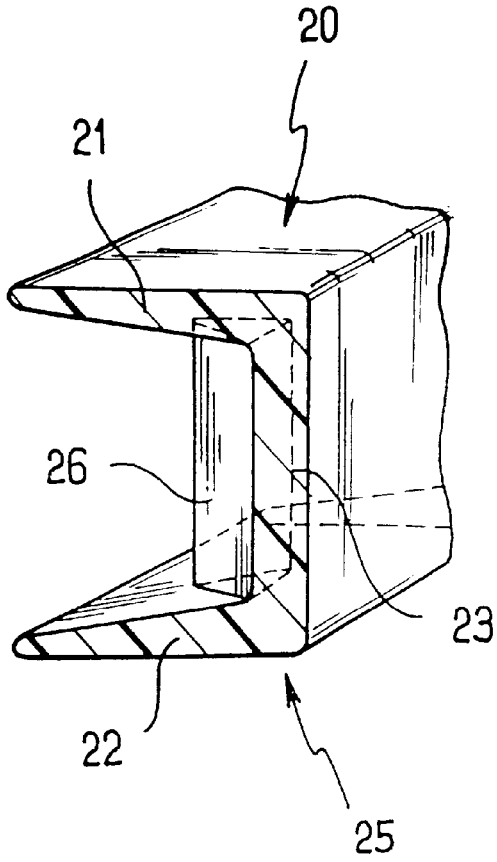
FIG. 4 is a fragmentary view in perspective and cross-section of the beam.

With reference to the figures, the pallet of the invention comprises support elements 10 in the form of planks having rough top surfaces 11. The support elements 10 are fixed via their opposite ends 12, 13 and their middle portions 14 to cross-connection beams 20.

The cross-connection beams 20 are of channel section, each presenting a top flange 21 and a bottom flange 22 interconnected by a web 23. The support elements 10 are fixed to the top flange 21.

Two spaced-apart recesses 24 cut out both in the bottom flange 22 and in the web 23 serve to provide passages for the tines of a conventional type of forklift truck. Each cross-connection beam thus constitutes three brackets given overall references 25 and interconnected by the top flange 21. It should be observed at this point that each recess 24 is made in a bottom portion of the web 23 in such a manner that the remaining portion of the web 23 extends along the top of the recess between the brackets. Other recess configurations are possible.

The facing portions of the bottom flanges 22 belonging to the three cross-connection beams are interconnected by three stiffener elements 30 which extend parallel to the support elements 10. The stiffener elements 30 are in the form of planks each comprising a bottom surface 31 having longitudinal grooves 32 and a top surface 33 to which the bottom flanges 22 of the cross-connection beams 20 are fixed. The top longitudinal edges 34 of the stiffener elements 30 are chamfered. The ends of the tines of forklift trucks are generally chamfered underneath so that by cooperating with these chamfer portions, the chamfers form ramps that guide the ends of the tines over the elements 30. The risk of impact between the elements 30 and the tines is thus reduced. This also serves to make the stiffener elements lighter in weight.

The various elements constituting the pallet are assembled together by screws, nails, adhesive, heat-sealing, or a combination of such means.

Figure 5:
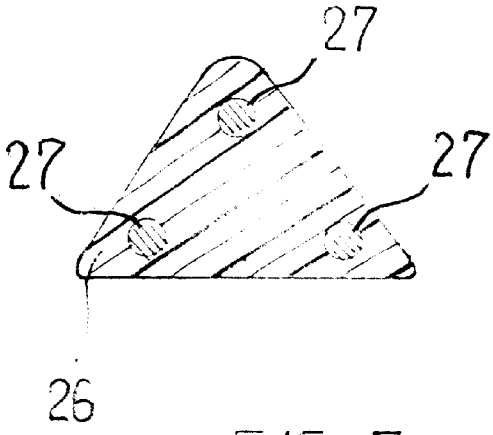
FIG. 5 is a cross-section view of a reinforcing rib for the FIG. 4 beam.

Preferably, the pallet or at least some of the elements thereof are assembled together by nailing. Under such circumstances, the reinforcing rib 26 is advantageously of a cross-section that is greater in dimension than the cross-section of at least one nail 27 so that the nail can be nailed into the reinforcing rib 26. The reinforcing rib 26 then performs two functions, namely a function of reinforcing the bracket, and also a function of receiving the nail 27. Preferably, and as shown in FIG. 5, the cross-section of the reinforcing rib 26 enables it to receive three nails 27 nailed into the reinforcing rib 26, and also into one of the support elements 10 and into the top flange 21, for example, so as to serve as fixing means for securing said support element 10 to the bracket 25. These nails could also be received by providing local extra thickness in the top flange 21 at the brackets 25 to enable fixing nails to be nailed into the support elements 10.

It will be understood that the palle is designed to stand on the ground via the stiffener elements 30 which form a base plank and is intended to support goods on the support elements 10 which form a tray on which the goods can stand. The cross-connection beams 20 hold the elements 10 and 30 together and maintain a space between them for receiving the tines of a forklift truck. Naturally, the invention applies to any type of pallet and in particular to pallets that do not have stiffener elements or to pallets in which the support elements are replaced by a single plate.

The elements of the pallets of the invention and given overall references 10, 20, and 30 are made from a thermoplastic material which comprises, by weight, substantially:

55% recycled polyethylene terephthalate;

33% recycled high density polyethylene;

5% compatibility agent; and

7% reinforcing filler.

The composition of the thermoplastic material can vary, but the proportions by weight of the various components preferably lie substantially within the following ranges:

49% to 63.5% for the polyethylene terephthalate;

27% to 36% for the high density polyethylene;

4% to 6% for the compatibility agent; and

5% to 10% for the reinforcing filler.

Adding high density polyethylene makes it possible to obtain a material that is more amorphous than if polyethylene terephthalate were used on its own (since it is highly crystalline). This improves the mechanical strength of the resulting material.

The compatibility agent is for example that referenced LOTADER AX8900 from Elf Atochem, and it is used for homogenizing the mixture of recycled polyethylene terephthalate and recycled high density polyethylene. Naturally, other compatibility agents having comparable properties could also be used.

The reinforcing filler used can be made of glass fibers such as those produced under the reference 3540 by PPG. These fibers are 3 millimeters (mm) long and they improve Young's modulus and impact strength.

The reinforcing filler can also be made of glass flakes of the type produced under the reference MICROGLAS by NGF Europe. These flakes make it possible to increase Young's modulus and to increase elongation, thereby also increasing impact strength. Furthermore, the use of glass flakes serves to limit the increase in the viscosity of the mixture due to introducing said flakes therein as compared with introducing fibers. It seems likely that the flakes have an influence firstly on crystallinity and secondly on shrinkage, thereby limiting the appearance of microcracks.

Other reinforcing fillers can be used on their own or in combination, e.g. glass microbeads. A mixture of glass fibers and glass flakes can thus be used.

Naturally, other types of filler can be added to the mixture. Such fillers can include an emulsifier such as zinc carbonate. This makes it possible to create bubbles in the material, thereby reducing the mass of bars made out of said material. Pigments can also be added in order to color the material.

The elements 10, 20, and 30 are made by extrusion molding or by extrusion-intrusion.

The recycled polyethylene terephthalate and the recycled high density polyethylene used are preferably in the form of flakes obtained by grinding polyethylene terephthalate waste and high density polyethylene waste and by washing the resulting flakes. It would also be possible to use granules of such material but that would require additional operations (mixing flakes of each of the materials with fillers, extruding the mixtures, cooling, and then grinding into granules).

The polyethylene terephthalate flakes are initially dried, e.g. in a desiccator, so as to prevent any hydrolysis occurring of the polyethylene terephthalate during subsequent extrusion thereof. It has been found that such hydrolysis directly causes the impact strength of the polyethylene terephthalate to be reduced. The high density polyethylene can also be dried.

The flakes of polyethylene terephthalate and of high density polyethylene, the compatibility agent, and the reinforcing fillers are then mixed together and introduced into the feed hopper of an extruder. It is important to ensure that the flakes descend in regular manner inside the hopper.

In this example, the temperature of the heating body of the extruder is about 250° C. at the hopper end and about 275° C. at the outlet from the extruder. In order to ensure that the various components of the thermoplastic material are properly mixed together, the transit time of the material in the extruder preferably lies in the range 1 minute to a few minutes. The transit time of the material through the extruder is determined in particular by the length of the extruder screw, its pitch, and its speed of rotation.

On leaving the extruder, a paste mixture is obtained which is introduced directly into a mold whose shape corresponds to the beam which is to be made (the extruder opens out directly into the mold through an orifice formed in its wall). It will be observed that if the inside shape of the mold is complex, it might be necessary to provide a plurality of orifices for injecting the material. The pressure for injecting the material into the mold is obtained by the thrust force exerted on the mixture by the extruder screw. When an emulsifier is added to the mixture, a portion of the injection pressure is provided by emulsification. Under such circumstances, the transit time of the material in the extruder is preferably determined in such a manner that emulsification takes place inside the extruder and not inside the mold (since if emulsification occurs inside the mold, then it is more difficult to determine the quantity of material that needs to be introduced into the mold).

Once the mold has been filled, it is plunged into a bath of cold water, e.g. at a temperature equal to or lower than 20° C. This makes it possible to obtain a beam which presents a relatively thick surface layer in an amorphous phase which is relatively flexible and improves the mechanical properties of the material and in particular its impact strength. Other methods of cooling could naturally be used, and in particular the parts themselves could be plunged into a bath, or the parts or the molds containing them could be maintained in a stream of cold gas.

Naturally, the invention is not limited to the embodiment described and variant embodiments can be provided without going beyond the ambit of the invention as defined by the claims.

In particular, the pallet can be made out of materials other than that described. The elements 10 and 30 can in particular be constituted by wooden planks, while the beams 20 can be made out of the above-described thermoplastic material or out of a thermoplastic material having mechanical characteristics adapted to this utilization, which thermoplastic material can be recycled or otherwise. In this variant, the wooden planks are nailed in conventional manner to the beam 20. Compared with a conventional wooden pallet, this structure makes it possible to improve the ability of the wooden planks to withstand being torn off.

In addition, the material used for one or more elements of the pallet could be a composite material of conventional type.

Other methods of making the elements of the pallet could also be envisaged.

What is claimed is:

1. A goods pallet comprising parallel support elements having at least end portions fixed by assembly means to cross-connection elements, wherein each cross-connection element comprises a beam made of thermoplastic material, the beam is of channel section having a top flange to which the support elements are fixed, and a web and a bottom flange which are both recessed by at least one notch to form two spaced-apart brackets on either side thereof that are integral with the top flange, wherein the beam comprises at least one reinforcing rib on at least one of its brackets, the reinforcing rib extending over the web between the top and bottom flanges.

2. A pallet according to claim 1, further comprising at least one stiffener element extending parallel to the support elements and at a distance therefrom between two opposite brackets, the stiffener element being in the form of a plank.

3. A pallet according to claim 2, wherein the bottom surface of the plank-shaped element is grooved.

4. A pallet according to claim 2, wherein the stiffener element has at least one chamfer formed in at least one of its top longitudinal edges.

5. A pallet according to claim 1, wherein at least one of the cross-connection elements is fixed to a bracket by means of at least one nail, the bracket including means for receiving the nail which is nailed into it.

6. A pallet according to claim 1, wherein the thermoplastic material comprises:

recycled polyethylene terephthalate;

recycled high density polyethylene;

a compatibility agent; and a reinforcing filler.

7. A pallet according to claim 6, wherein the thermoplastic material substantially comprises, by weight:

49% to 63.5% polyethylene terephthalate;

27% to 36% high density polyethylene;

4% to 6% compatibility agent; and

5% to 10% reinforcing filler.

8. A pallet according to claim 7, wherein the thermoplastic material substantially comprises, by weight:

55% polyethylene terephthalate;

33% high density polyethylene;

5% compatibility agent; and

7% reinforcing filler.

9. A pallet according to claim 6, wherein the reinforcing filler comprises glass flakes.

10. A pallet according to claim 6, wherein the reinforcing filler comprises glass fibers.

11. A goods pallet comprising parallel support elements having at least end portions fixed by assembly means to cross-connection elements, wherein each cross-connection element comprises a beam made of thermoplastic material, the beam is of channel section having a top flange to which the support elements are fixed, and a web and a bottom flange which are both recessed by at least one notch to form two spaced-apart brackets on either side thereof that are integral with the top flange, wherein at least one of the cross-connection elements is fixed to a bracket by means of at least one nail, the bracket including means for receiving the nail which is nailed into it, and wherein the beam comprises at least one reinforcing rib on at least one of its brackets, the reinforcing rib extending over the web between the top and bottom flanges and wherein the reinforcing rib has a cross-section which is greater than that of the nail so as to enable the nail to be nailed into the reinforcing rib.

12. A pallet according to claim 11, further comprising at least one stiffener element extending parallel to the support elements and at a distance therefrom between two opposite brackets, the stiffener element being in the form of a plank.

13. A pallet according to the claim 12, wherein bottom surface of the plank-shaped element is grooved.

14. A pallet according to claim 12, wherein the stiffener element has at least one chamfer formed in at least one of its top longitudinal edges.

15. A pallet according to claim 11, wherein the thermoplastic material comprises:

recycled polyethylene terephthalate;

recycled high density polyethylene;

a compatibility agent; and a reinforcing filler.

16. A pallet according to claim 15, wherein the thermoplastic material substantially comprises, by weight:

49% to 63.5% polyethylene terephthalate;

27% to 36% high density polyethylene;

4% to 6% compatibility agent; and

5% to 10% reinforcing filler.

17. A pallet according to claim 16, wherein the thermoplastic material substantially comprises, by weight:

55% polyethylene terephthalate;

33% high density polyethylene;

5% compatibility agent; and

7% reinforcing filler.

18. A pallet according to claim 15, wherein the reinforcing filler comprises glass flakes.

19. A pallet according to claim 15, wherein the reinforcing filler comprises glass fibers.

* * * * *